US010374353B2

(12) United States Patent
Archuleta et al.

(10) Patent No.: US 10,374,353 B2
(45) Date of Patent: Aug. 6, 2019

(54) MAGNETIC COUPLING FOR BULBS AND SOCKETS

(71) Applicants: Michael Archuleta, Austin, TX (US); Jeri Archuleta, Austin, TX (US)

(72) Inventors: Michael Archuleta, Austin, TX (US); Jeri Archuleta, Austin, TX (US)

( * ) Notice: Subject to any disclaimer, the term of this patent is extended or adjusted under 35 U.S.C. 154(b) by 0 days.

(21) Appl. No.: 15/570,351

(22) PCT Filed: Apr. 29, 2016

(86) PCT No.: PCT/US2016/030072

§ 371 (c)(1),
(2) Date: Oct. 29, 2017

(87) PCT Pub. No.: WO2016/176564

PCT Pub. Date: Nov. 3, 2016

(65) Prior Publication Data

US 2018/0145446 A1 May 24, 2018

Related U.S. Application Data

(60) Provisional application No. 62/154,627, filed on Apr. 29, 2015.

(51) Int. Cl.
*H01R 13/62* (2006.01)
*H01R 33/22* (2006.01)
(Continued)

(52) U.S. Cl.
CPC ..... *H01R 13/6205* (2013.01); *F21V 19/006* (2013.01); *F21V 21/096* (2013.01);
(Continued)

(58) Field of Classification Search
CPC ..... H01R 13/6205
(Continued)

(56) References Cited

U.S. PATENT DOCUMENTS 2,218,173 A * 10/1940 Kulka ..... F21V 17/06 362/453
2,244,044 A * 6/1941 Bishop ..... H01H 85/32 313/269
(Continued)

FOREIGN PATENT DOCUMENTS

FR 2612002 9/1988
FR 2620276 3/1989
(Continued)

OTHER PUBLICATIONS

International Search Report and Written Opinion, International Application No. PCT/US2016/030072, dated Jun. 9, 2016.

*Primary Examiner* — Ross N Gushi
(74) *Attorney, Agent, or Firm* — Johnson & Associates

(57) ABSTRACT

A system and method is provided for easily and securely coupling objects together. In some examples, a coupling mechanism enables a user to install, remove, or replace conventional light bulbs (116) in conventional light bulb sockets (114), without the need to rotate the light bulb (116) several revolutions. A coupling mechanism uses a first adapter (112) threaded onto a conventional light bulb (116) and a second adapter (110) threaded onto a conventional light bulb socket (114). The first and second adapters (112, 110) use a combination of mechanical and magnetic coupling techniques to secure the light bulb (116) to the socket (114).

16 Claims, 9 Drawing Sheets

(51) Int. Cl.

| | |
|---|---|
| ***H01R 33/94*** | (2006.01) |
| ***F21V 19/00*** | (2006.01) |
| ***F21V 21/096*** | (2006.01) |
| ***H01F 7/02*** | (2006.01) |
| ***F21V 23/06*** | (2006.01) |
| ***H01R 13/622*** | (2006.01) |
| ***H01R 31/06*** | (2006.01) |

(52) U.S. Cl.
CPC ..... *F21V 23/06* (2013.01); *H01F 7/0247* (2013.01); *H01R 13/622* (2013.01); *H01R 31/06* (2013.01); *H01R 33/22* (2013.01); *H01R 33/94* (2013.01)

(58) Field of Classification Search
USPC ..... 439/38, 39
See application file for complete search history.

(56) References Cited

U.S. PATENT DOCUMENTS 2,786,189 A * 3/1957 Sargis ..... H01R 33/05 439/349
2,788,501 A * 4/1957 Buquor ..... H01J 5/56 439/39
3,070,767 A * 12/1962 Rabinow ..... H01R 33/94 338/70
3,808,577 A * 4/1974 Mathauser ..... H01R 13/6205 439/180
4,156,265 A 5/1979 Rose
4,183,604 A * 1/1980 Tjornhom, Sr. ..... H01R 33/94 29/764
4,318,159 A 3/1982 Kaisner
5,006,751 A * 4/1991 Marshall ..... F21V 19/0005 313/318.04
5,016,145 A 5/1991 Singleton
5,380,214 A * 1/1995 Ortega, Jr. ..... H01R 33/22 439/253
5,382,181 A * 1/1995 Ortiz ..... H01R 33/20 439/628
5,758,959 A 6/1998 Sieczkowski
5,989,070 A * 11/1999 Al-Turki ..... F21V 19/006 439/638
6,380,683 B1 * 4/2002 Kahn ..... H01J 5/50 315/56
7,066,739 B2 * 6/2006 McLeish ..... H01R 13/6205 439/39
7,329,128 B1 * 2/2008 Awad ..... H01R 13/6205 439/38
7,364,433 B2 * 4/2008 Neidlein ..... H01R 13/24 439/39
7,462,052 B2 12/2008 Karton
7,607,920 B1 * 10/2009 Chen ..... H01R 31/06 439/39
7,874,844 B1 * 1/2011 Fitts, Jr. ..... H01R 31/06 439/218
7,905,626 B2 * 3/2011 Shantha ..... H01J 5/54 362/228
8,002,585 B2 * 8/2011 Zhou ..... F21V 19/04 439/320
8,651,711 B2 2/2014 Rudisill et al.
8,702,437 B2 * 4/2014 Fullerton ..... H01R 13/6205 439/236
8,760,070 B2 6/2014 Flandre et al.
9,146,023 B2 * 9/2015 Keser ..... F21V 19/0005
9,413,104 B2 * 8/2016 Liao ..... H01R 13/6205
9,478,929 B2 * 10/2016 Smith ..... H01R 33/22
9,531,118 B2 * 12/2016 Byrne ..... H01R 13/2421
9,557,716 B1 * 1/2017 Inamdar ..... G04G 17/06
9,608,394 B2 * 3/2017 Fruhauff ..... H01R 33/94
10,008,817 B2 * 6/2018 Fullerton ..... H01R 31/065
2005/0231951 A1 * 10/2005 Hirsch ..... H01R 33/0809 362/260
2005/0255719 A1 * 11/2005 Heidlein ..... H01R 13/24 439/39
2006/0152945 A1 7/2006 Lantzsch et al.
2006/0170323 A1 * 8/2006 Hirsch ..... H01J 5/54 313/318.01
2006/0285338 A1 12/2006 Meinecke
2007/0254510 A1 * 11/2007 DeBey ..... H01R 13/6205 439/188
2007/0287302 A1 * 12/2007 Lindberg ..... H01R 13/6205 439/38
2010/0068899 A1 * 3/2010 Shvili ..... F21V 19/006 439/39
2010/0167576 A1 * 7/2010 Zhou ..... H01J 61/327 439/375
2011/0115372 A1 5/2011 Tokes et al.
2012/0148195 A1 * 6/2012 Umeno ..... G02B 6/3817 385/53
2013/0040469 A1 * 2/2013 Hsu ..... H01R 13/6205 439/39
2013/0210244 A1 * 8/2013 DiFonzo ..... H01R 13/6205 439/39
2013/0303001 A1 * 11/2013 Greig ..... H01R 13/205 439/39
2014/0099801 A1 * 4/2014 Liao ..... H01R 13/6205 439/39
2014/0099808 A1 * 4/2014 McClelland ..... H01R 13/6205 439/153
2014/0162468 A1 * 6/2014 Kim ..... H01R 13/6205 439/39
2015/0318638 A1 * 11/2015 McClelland ..... H01R 13/629 439/105
2016/0020557 A1 * 1/2016 Daoura ..... H01R 13/6205 439/38
2017/0062999 A1 * 3/2017 Thiers ..... H04M 1/0274
2017/0331223 A1 * 11/2017 Cooper ..... A47J 37/0611
2017/0365952 A1 * 12/2017 He ..... H01R 13/24
2018/0090885 A1 * 3/2018 Ejiri ..... H01R 13/6205
2018/0109054 A1 * 4/2018 Chin ..... H01R 13/6205
2018/0145446 A1 * 5/2018 Archuleta ..... F21V 23/06

FOREIGN PATENT DOCUMENTS

| | | |
|---|---|---|
| FR | 2638907 | 5/1990 |
| GB | WO 2005104304 | 11/2005 |
| JP | 56-147380 | 11/1981 |

* cited by examiner

MAGNETIC COUPLING FOR BULBS AND SOCKETS

CROSS REFERENCE TO RELATED APPLICATIONS

This application is a US national stage application of co-pending commonly owned PCT application number PCT/US2016/030072, filed on Apr. 29, 2016, entitled "MAGNETIC COUPLING FOR BULBS AND SOCKETS," which claims priority to commonly owned U.S. patent application No. 62/154,627, filed on Apr. 29, 2015, entitled "MAGNETIC COUPLING FOR BULBS AND SOCKETS," which are each incorporated by reference herein.

FIELD

This disclosure relates to a novel coupling system. In particular, in some examples, this disclosure is drawn to adapter assemblies that can be used with conventional light bulbs and sockets to improve the usability and convenience of the light bulbs and sockets by providing an easy way to install and remove the light bulbs.

BACKGROUND

Typical light bulbs have male threads configured to fasten to the female threads of a light socket. There are many types of threaded sockets. For example, the most common light bulbs and sockets use "Edison screws". Commonly used thread sizes include E12, E17, E26, E39, etc., which differ in thread size. Other sockets types are also used. Some light bulbs are secured to sockets using a bayonet mount. A typical bayonet mount has opposing L-shaped slots formed in the socket, and matching pins formed on the bulb.

To install a typical light bulb having a threaded coupling, a user presses the bulb into a light socket, while rotating the light bulb several turns (e.g., clockwise) to couple the light bulb to the socket. Similarly, to remove a light bulb, a user turns the light bulb in the opposite direction (e.g., counter-clockwise). To install a typical light bulb having a bayonet mount, a user inserts the bulb into the socket with the pins aligned with the slots, and then turns the bulb slightly so the pins are pushed into a serif (a short lateral segment at the end of the slot). While these coupling systems can be simple, if the light bulb is in a difficult to reach location, such as in a ceiling fan, a high light fixture, etc., installing or replacing light bulbs can be cumbersome and difficult.

SUMMARY

An apparatus is provided for coupling light bulbs including a first adapter configured to attach to a light bulb socket, the first adapter having a cavity with a plurality of grooves formed in the cavity, for each of the plurality of grooves, a first magnetic material coupled to the first adapter in the proximity of a respective groove, a second adapter configured to attach to a light bulb, the second adapter having a plurality of protrusions extending from the second adapter, and for each of the plurality of protrusions, a second magnetic material coupled to the second adapter in the proximity of a respective protrusion, wherein the first and second magnetic materials attract each other to bias the first and second adapters in a position where each of the plurality of protrusions are positioned in a respective groove proximate the respective first magnetic material.

Another embodiment provides a method of coupling light bulbs to light bulb sockets including providing a first adapter, the first adapter having a plurality of protrusions extending radially outward from the respective adapter, each of the plurality of protrusions including a first magnetic material, providing a second adapter, the second adapter having a cavity with a plurality of grooves formed therein, each of the plurality of grooves having a termination point with a second magnetic material in the proximity of the respective termination point, wherein the first and second magnetic materials attract one another, attaching one of the first or second adapters to a light bulb and attaching the other to a light bulb socket, and placing the first and second adapters together such that each protrusion is positioned proximate a termination point of a respective groove and each first magnetic material is positioned proximate a respective second magnetic material.

Another embodiment provides coupling mechanism for coupling two objects together, the coupling mechanism including a first coupling member configured to attach to a first object, the first coupling member having a cavity with a plurality of grooves formed in the cavity, for each of the plurality of grooves, a first magnetic material coupled to the first coupling member in the proximity of a respective groove, a second coupling member configured to attach to a second object, the second coupling member having a plurality of protrusions extending from the second coupling member, and for each of the plurality of protrusions, a second magnetic material coupled to the second coupling member in the proximity of a respective protrusion, wherein the first and second magnetic materials attract each other to bias the first and second coupling members in a position where each of the plurality of protrusions are positioned in a respective groove proximate the respective first magnetic material.

Other features and advantages of the present disclosure will be apparent from the accompanying drawings and from the detailed description that follows below.

BRIEF DESCRIPTION OF THE DRAWINGS

The present disclosure is illustrated by way of example and not limitation in the figures of the accompanying drawings, in which like references indicate similar elements and in which:

FIG. 15 is an exploded sectional view depicting another embodiment of a coupling mechanism.

FIG. 16 is a sectional view depicting the coupling mechanism of FIG. 15 assembled.

FIG. 21 is an exploded side view depicting a coupling mechanism used to couple two objects.

FIG. 22 is a side view depicting a coupling mechanism used to couple two objects.

DESCRIPTION

The present disclosure describes coupling mechanisms to easily and securely couple objects together. In some embodiments, systems are disclosed that enable a user to install, remove, or replace conventional light bulbs in conventional light bulb sockets, without the need to rotate the light bulb several revolutions, as is normally done. While the coupling mechanisms described may be applied to any desired application, by way of example, detailed examples of coupling mechanisms applied to conventional light bulbs will be described.

Generally, the present disclosure describes a system that uses a set of adapters to provide an improved light bulb coupling system. In some embodiments, a first adapter is threaded to the male threads of a conventional light bulb and a second adapter is threaded to the female threads of a conventional light bulb socket. Note that the adapters can be configured for use with any types of bulb and socket, besides just threaded bulbs and sockets. For example, the adapters can be configured to be used with bulbs and sockets with screw bases, twist and lock bases, specialty bases, pin bases, bayonet bases, plug-in bases, etc. The first and second adapters are configured in such a way that the adapters can be quickly, easily, and securely coupled together, thus making the process of installing or replacing light bulbs easier. Several exemplary coupling mechanisms are described below, including magnetic coupling and mechanical/magnetic coupling. Other coupling techniques may also be used. The adapters can also be used as adapters from one type of bulb to another. In other words, the adapters can be configured to accommodate a screw base bulb with a non-screw base socket. In other words, a bulb adapter can be configured to accommodate one type of bulb, and a base adapter can be configure to accommodate a different type of socket.

Figure 1:
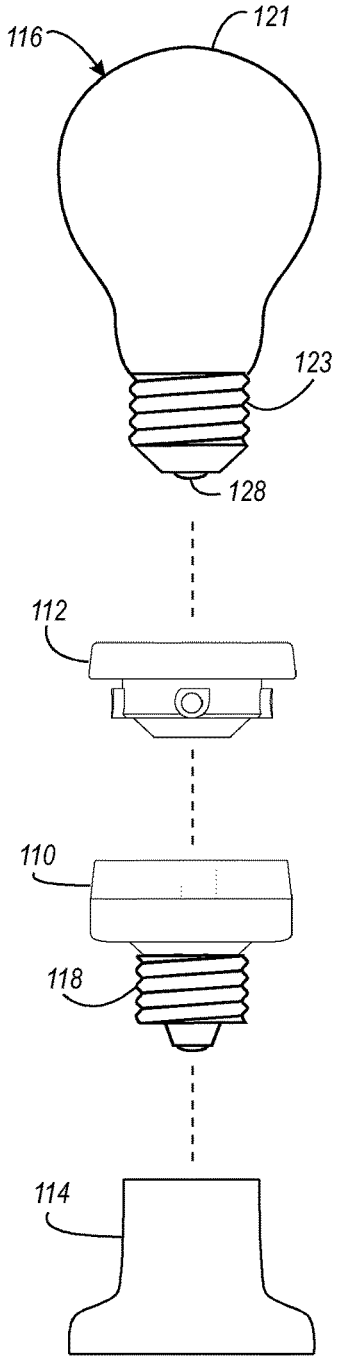
FIG. 1 is an exploded view depicting a base adapter, a bulb adapter, a light socket, and a light bulb.

FIGS. 1-14 are diagrams depicting a first example of first and second adapters used to couple a conventional light bulb to a conventional socket. FIG. 1 is an exploded view showing a base adapter 110, a bulb adapter 112, a conventional light socket 114, and a conventional light bulb 116. The light socket 114 may be any type of socket, including a lamp socket, light fixture socket, etc. The light bulb 116 may be any type of light, for example, an incandescent light, a compact fluorescent light, an LED light, etc. In the example shown in FIG. 1, the light bulb 116 includes a glass or plastic bulb 121, and threaded cap 123, and an electrical contact 128. In this example, the threaded cap 123 is an E26 fitting. Power is provided to the light bulb 116 via the cap 123 and the contact 128.

Figure 2:
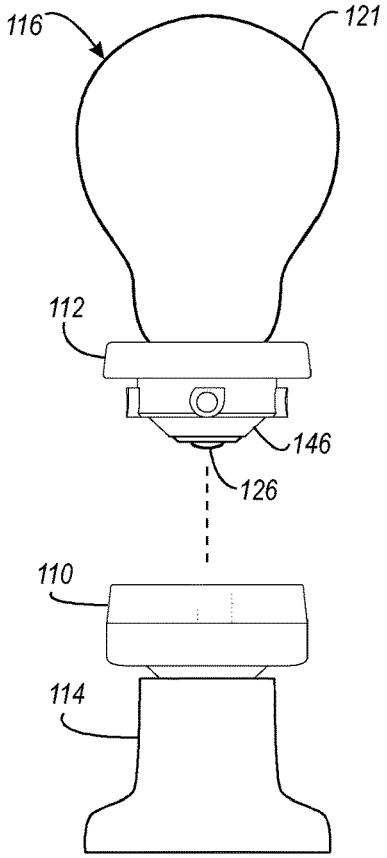
FIG. 2 is an exploded view depicting the base adapter and bulb adapter shown in FIG. 1 secured to a light socket and a light bulb.
Figure 3:
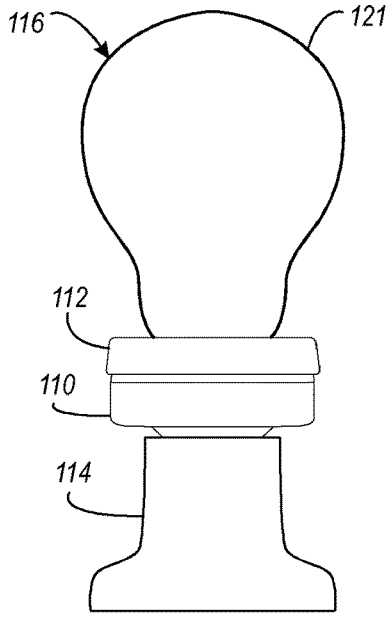
FIG. 3 is a side view depicting a light bulb secured to a light socket using the base adapter and bulb adapter shown in FIG. 1.

As is described in detail below, the bulb adapter 112 has female threads configured to receive the male threads of a light bulb. The base adapter 110 includes male threads 118, configured to screw into the female threads of a light socket. The base adapter 110 and the bulb adapter 112 include a coupling mechanism that enables the base adapter 110 and the bulb adapter 112 to be easily and securely coupled together. FIG. 2 is an exploded view depicting the base adapter 110 secured to the light socket 114 and the bulb adapter 112 secured to the light bulb 116. Once both adapters 110 and 112 are secured to the socket 114 and bulb 116, the light bulb 116 can be easily installed, as is described in detail below. In addition to providing a mechanical coupling, the adapters 110 and 112 provide an electrical connection between the light bulb 116 and the socket 114 (described below). FIG. 3 is a side view of the light bulb 116 secured to the light socket 114 via the adapters 110 and 112.

Figure 4:
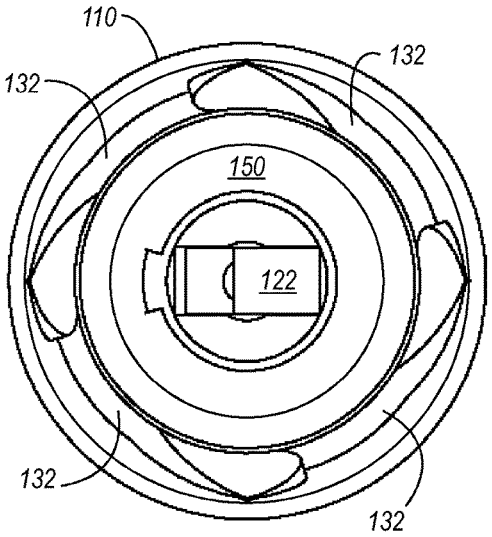
FIG. 4 is a top view depicting the base adapter shown in FIG. 1.
Figure 5:
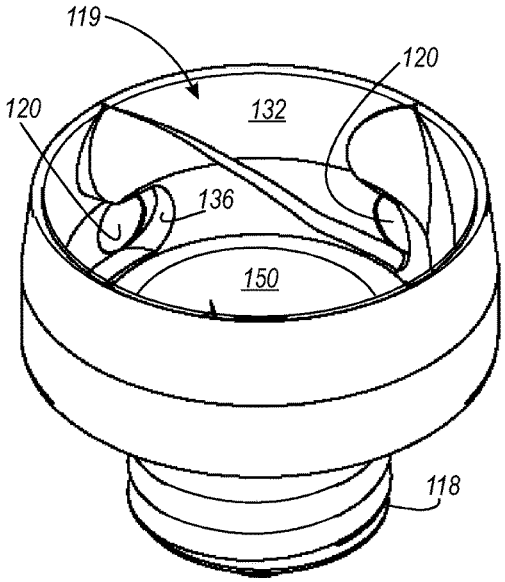
FIG. 5 is a top isometric view depicting the base adapter shown in FIG. 1.
Figure 6:
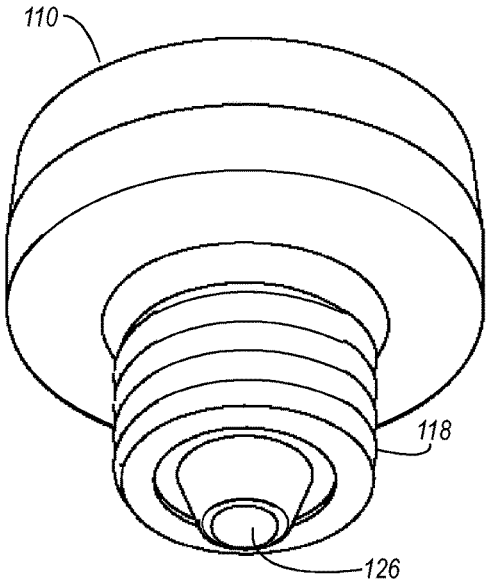
FIG. 6 is a bottom isometric view depicting the base adapter 110 shown in FIG. 1.
Figure 7:
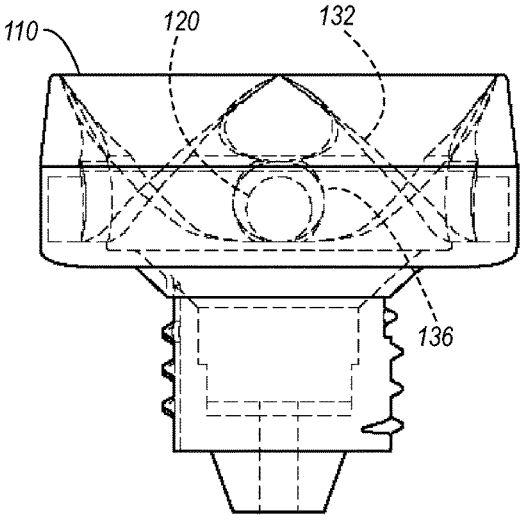
FIG. 7 is a side view depicting the base adapter shown in FIG. 1.

FIGS. 4-7 depict details of one embodiment of a base adapter 110. FIG. 4 is a top view of the base adapter 110 shown in FIG. 1. FIG. 5 is a top isometric view of the base adapter 110 shown in FIG. 1. FIG. 6 is a bottom isometric view of the base adapter 110 shown in FIG. 1. FIG. 7 is a side view of the base adapter 110 shown in FIG. 1 using hidden lines to show various details of the base adapter 110. FIG. 1 also includes a side view of the base adapter 110.

Figure 14:
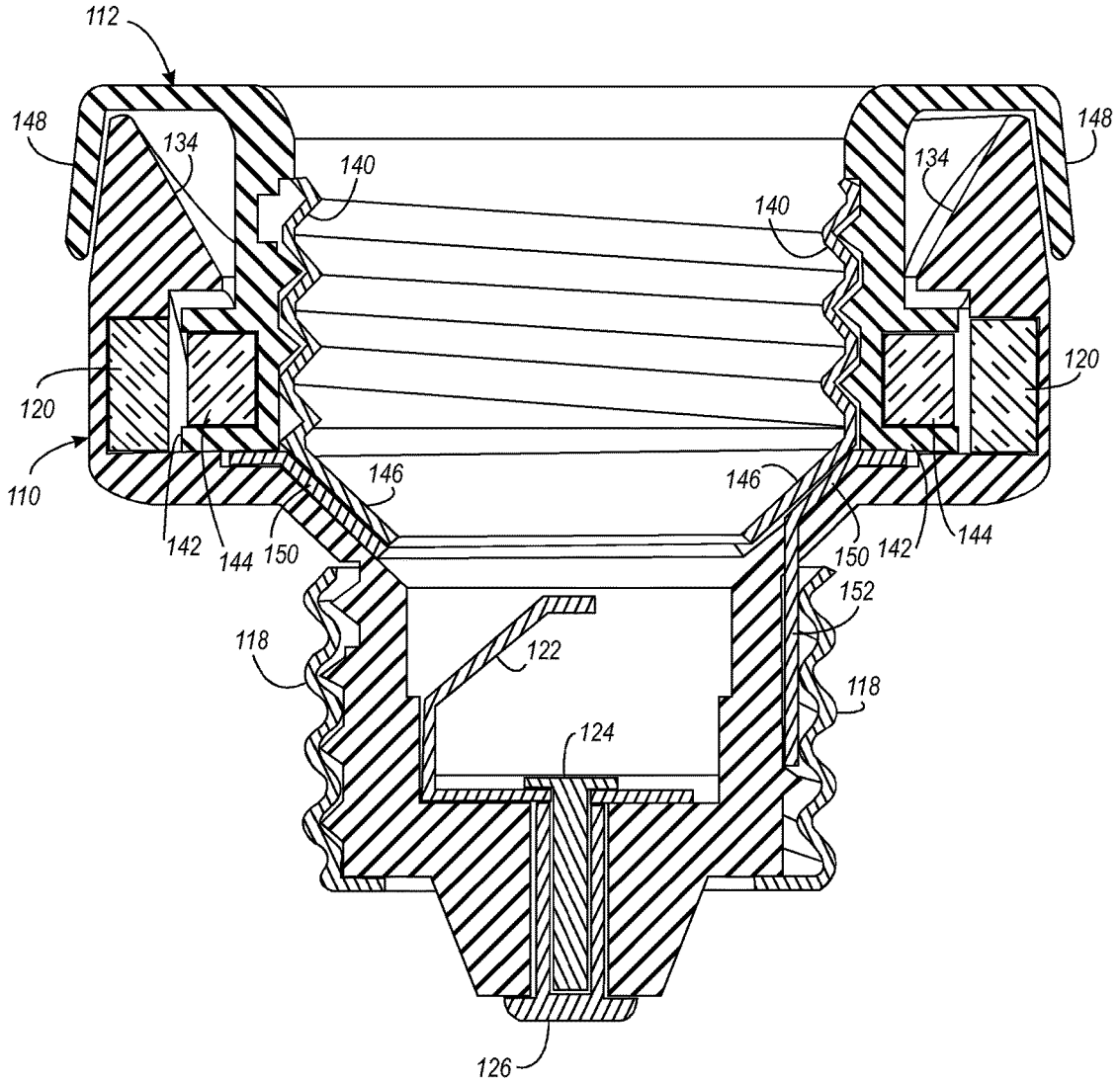
FIG. 14 is an enlarged cross-sectional view depicting the bulb adapter installed in the base adapter shown in FIG. 1.

As mentioned above, in the embodiment shown, the socket adapter 110 has standard male threads 118 configured to thread into a conventional light socket, such as socket 114 shown in FIGS. 1 and 2. In one example, threads 118 comply with the Edison Screw (ES) ES26 standard. A cavity 119 is formed in the opposite end of the base adapter 110. The cavity 119 is configured to receive and secure the bulb adapter 112. The electrical connections needed to power the light bulb 116 are provided in the cavity 119, and are described in detail below with respect to FIG. 14. The base adapter 110 includes a center contact assembly that includes a center contact alligator 122 (FIGS. 4, 14) that is configured to make contact with the contact 128 of the light bulb. The alligator 122 is in electrical contact with male and female center contact pins 124 and 126, respectively (FIG. 14). During use, the female contact pin 126 makes electrical contact with the center conductor (not shown) of a light socket, thus providing an electrical connection between the light bulb contact 128 and the center conductor of the light socket.

Figure 19:
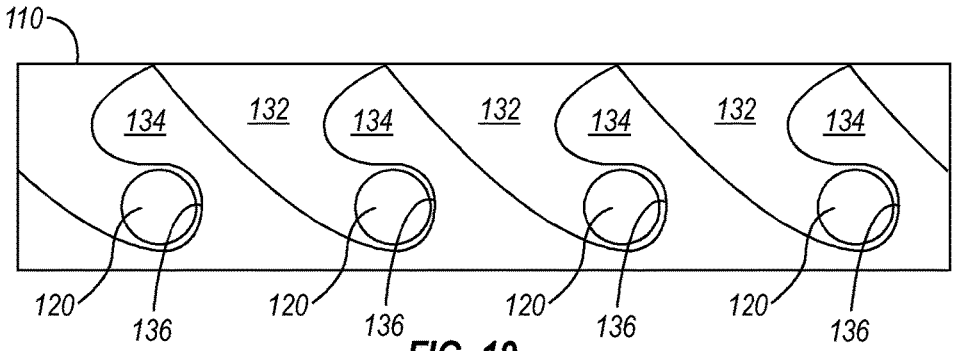
FIG. 19 is a view depicting the interior wall of the base adapter FIG. 1.
Figure 20:
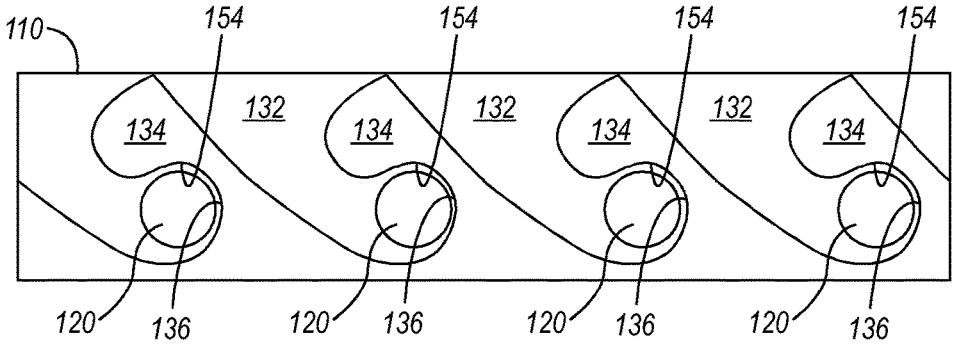
FIG. 20 is a view depicting the interior wall of another embodiment of a base adapter.

Within the cavity 119 of the base adapter 110 four downward sloping channels 132 are formed, and each terminate below a retention surface 134 at a termination point 136. FIGS. 19-20 (described below) show the channels 32, termination points 136, and retention surfaces 134 in more detail. As described below, the bulb adapter 112 includes four corresponding protrusions 142 (described below). When the adapter assembly is in use, the protrusions 142 will be guided below the retention surface 134 by the sloping channels 132. When the bulb adapter 112 is inserted into the base adapter 110, the channels 132 will guide each of the protrusions 142 of the bulb adapter 112 toward the respective termination point 136 as the base adapter 110 is rotated slightly (in this example, approximately ⅛ of a turn).

In the proximity of each of the termination points 136, a magnet 120 (or other magnetic material or magnetic receptive material) is formed in the wall of the base adapter 110. This is illustrated best in FIGS. 5, 14, and 19. When the bulb adapter 112 is inserted in the base adapter 110 with the protrusions 142 at or near the termination points 136, the bulb adapter 112 will be held securely in place by the magnets 120/144 and the retention surface 134. To remove a bulb, a user simply rotates the bulb counterclockwise (approximately ⅛ of a turn) until the protrusions 142 of the bulb adapter 112 are no longer beneath the retention surfaces 134.

Figure 8:
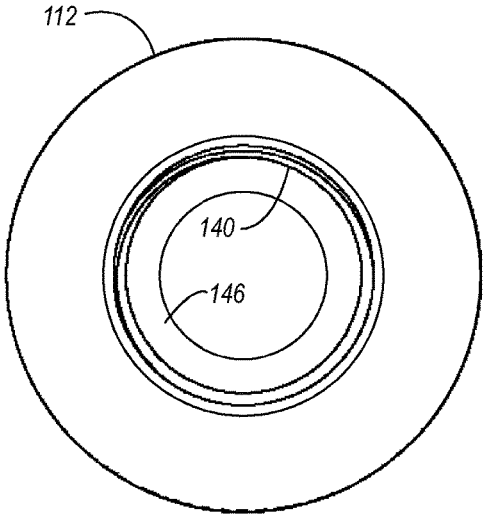
FIG. 8 is a top view depicting the bulb adapter shown in FIG. 1.
Figure 9:
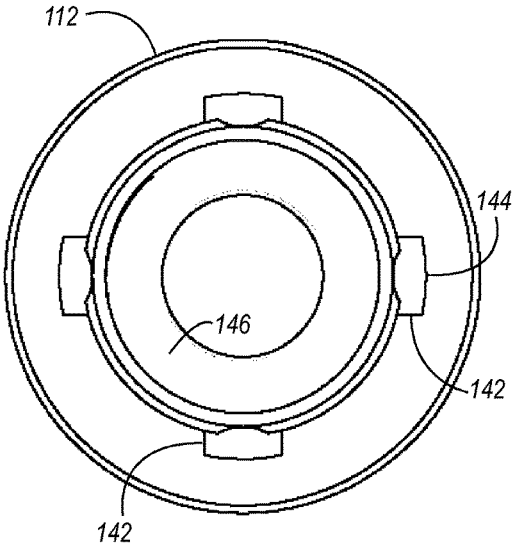
FIG. 9 is a bottom view depicting the bulb adapter shown in FIG. 1.
Figure 10:
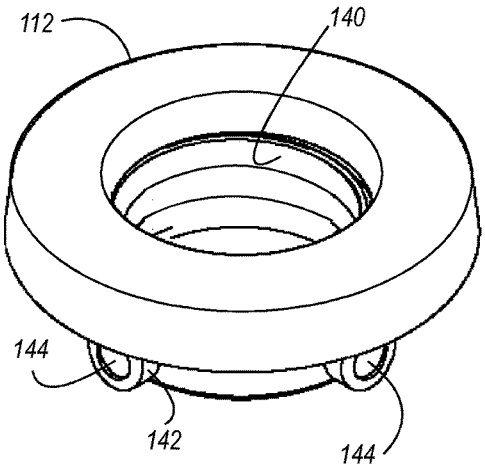
FIG. 10 is a top isometric view depicting the bulb adapter shown in FIG. 1.
Figure 11:
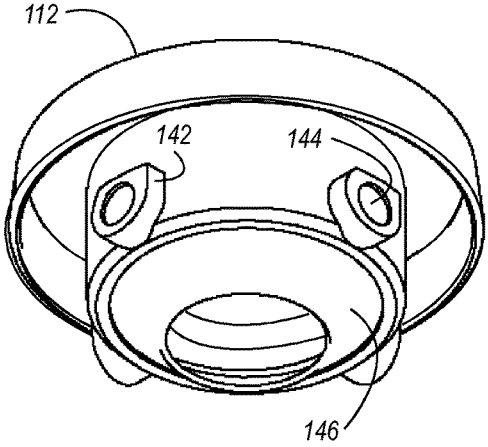
FIG. 11 is a bottom isometric view depicting the bulb adapter shown in FIG. 1.
Figure 12:
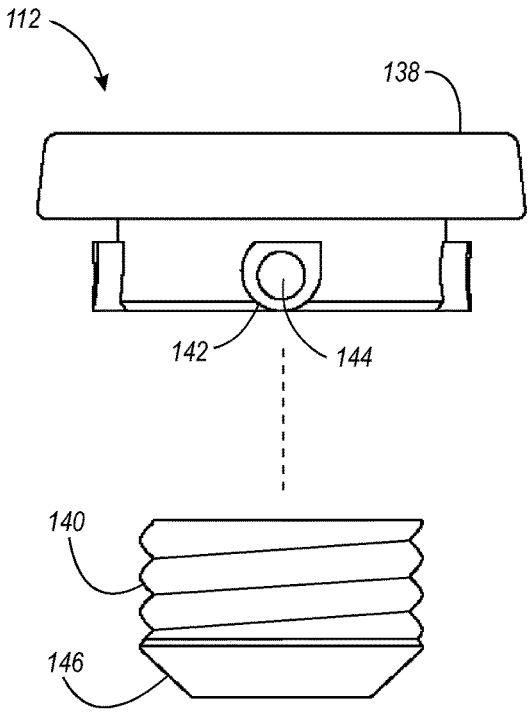
FIG. 12 is an exploded view depicting the bulb adapter shown in FIG. 1.
Figure 13:
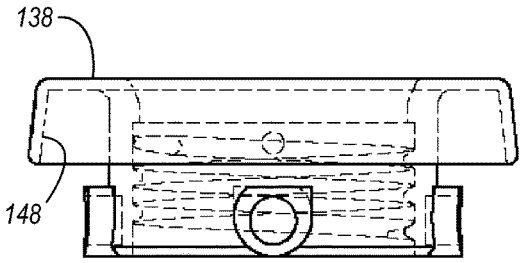
FIG. 13 is a partial side view depicting the bulb adapter shown in FIG. 1.

FIGS. 8-13 depict details of one embodiment of a bulb adapter 112. FIG. 8 is a top view of the bulb adapter 112 shown in FIG. 1. FIG. 9 is a bottom view of the bulb adapter 112 shown in FIG. 1. FIG. 10 is a top isometric view of the bulb adapter 112 shown in FIG. 1. FIG. 11 is a bottom isometric view of the bulb adapter 112 shown in FIG. 1. FIG. 1 includes a side view of the bulb adapter 112. FIG. 12 is an exploded view of the bulb adapter 112 shown in FIG. 1, showing a bayonet portion 138 and a screw shell 140. FIG. 13 is a side view of the bayonet portion 138 with hidden lines showing various features of the bayonet portion 138.

As shown in the figures, four protrusions 142 are formed near the bottom of the bulb adapter 112, extending radially from the bulb adapter 112. The protrusions 142 of the bulb adapter 112, in combination with the channels 132 of the base adapter 110, form a coupling mechanism similar to a bayonet-style coupling. A magnet 144 (or other magnetic material or magnetic receptive material) is disposed at each protrusion 142 to attract the corresponding magnet 120 of the base adapter 110. In one embodiment, magnets are used on both the bulb adapter 112 and base adapter 110. In other embodiments, a magnet in one adapter (the bulb adapter 112 or base adapter 110) corresponds to a magnetic receptive material in the other adapter, as desired. Using a magnet in combination with a magnetic receptive material (e.g., iron, other ferromagnetic materials, etc.) may reduce the cost of an adapter assembly, at the expense of a reduced magnetic attraction. In the examples shown, four protrusions 142 and corresponding channels 132 are used. In other examples, more or less protrusions/channels may be used (e.g., 1, 2, 3, 5, etc.), as desired.

As shown best in FIGS. 12 and 14, the screw shell 140 is disposed within the bulb adapter 112, and forms female threads for receiving a light bulb. The screw shell also provides an electrical connection between the threads of the cap 123 of the light bulb 116 and the base adapter 110 (described below). The screw shell 140 includes a bottom lip 146 that engages the bottom of the light bulb 116 (FIG. 2), and provides a stopping surface when screwing the light bulb 116 into the bulb adapter 112. The upper portion of the bulb adapter 112 forms a lip 148 (FIGS. 13, 14), which overlaps the base adapter 110 during use (FIGS. 3, 14), providing protection from rain, dirt, or other elements.

FIG. 14 is an enlarged cross-sectional view of the bulb adapter 112 installed in the base adapter 110. For clarity, a light bulb and a light socket are not shown. As shown, and as described above, the protrusions 142 of the bulb adapter 112 are disposed within the channels 132 of the base adapter 110 and below the retentions surfaces 134. As shown, the magnets 120 and 144 are relatively close each other, resulting in a strong attraction. The attraction of the magnets 120 and 144, along with the protrusions 142 being disposed within the channels 132 and below the retention surfaces 134, work tougher to hold the adapters 112 and 110 together.

As described above, the bulb adapter 112 and base adapter 110 provide the necessary electrical connections between a light bulb 116 and a light socket 114. The light bulb 116 requires a connection to the threaded cap 123 and the bulb contact 128. During use, the threaded cap 123 of the light bulb 116 engages and makes electrical contact with the screw shell 140 of the bulb adapter 112. When the bulb adapter 112 is secured to the base adapter 110, the screw shell 140 makes electrical contact with a contact ring 150 (FIGS. 4, 5, 14). The contact ring 150 includes a downward extending tab 152 (FIG. 14). The tab 152 makes electrical contact with the threads 118 of the base adapter 110 (FIG. 14), which makes electrical contact with the female threads of the light socket 114 (not shown), thus providing an electrical connection between the threaded cap 123 of the light bulb 116 with the female threads of the light socket 114. During use, the bulb contact 128 of the light bulb 116 makes electrical contact with the alligator 122 of the base adapter 110, which makes electrical contact with the pin 126 (FIG. 14), which makes contact with the center conductor of the light socket 114 (not shown), thus providing an electrical connection between the contact 128 of the light bulb 116 with the center contact of the light socket 114.

The adapter assembly shown in FIGS. 1-14 operates as follows. To install a light bulb using the embodiment illustrated in FIGS. 1-14, a base adapter 110 is screwed into the socket 114 of a light fixture (FIG. 2). A bulb adapter 112 is screwed onto the light bulb 116 to be installed (FIG. 2). With both adapters 110 and 112 installed, a user can merely insert the bulb 116 (along with the bulb adapter 112) into the cavity of the base adapter 110 until the base adapter 110 magnets 120 engage the bulb adapter magnets 144 as the protrusions 142 are guided through the channels 132. The engagement of the pairs of magnets pull the bulb to the installed position, providing tactile feedback (e.g., a snap or click that can be felt and/or heard) to the user, so the user can be sure that the light bulb is properly secured. The retention surfaces 134 prevent the bulb 116 from being pulled straight out. To remove the light bulb 116, a user will twist the bulb 116 slightly with sufficient force to overcome the magnetic force of the magnets holding the adapter assembly together. When replacing a bulb, the base adapter 110 can remain in place, and a new bulb installed using the same (or another) bulb adapter 112.

Note that the magnets used in the various embodiments described can be comprised of any desired type of magnetic material, for example, Neodymium, ferrite ceramic, etc. Also note that, when the description describes magnets and/or corresponding ferromagnetic materials, magnetic receptive materials, etc., the materials can be reversed. Where a magnetic coupling is used, the coupling can be accomplished using a magnet paired with another magnet, or by a magnet and a ferromagnetic material or magnetic receptive material.

In another example, a coupling mechanism, such as those described herein, can be incorporated in a light bulb and/or socket, so no adapters are needed. For example, a light bulb can be manufactured with the functionalities of the bulb adapter built in. Such a bulb may look like the combination of bulb 116 and adapter 112 shown in FIG. 2. A matching socket may look like the combination of socket 114 and adapter 110 shown in FIG. 2. In another example, bulb can be manufactured to incorporate the adapter 112 functionalities, and then used in conventional sockets with an adapter such as base adapter 110.

Figure 15:
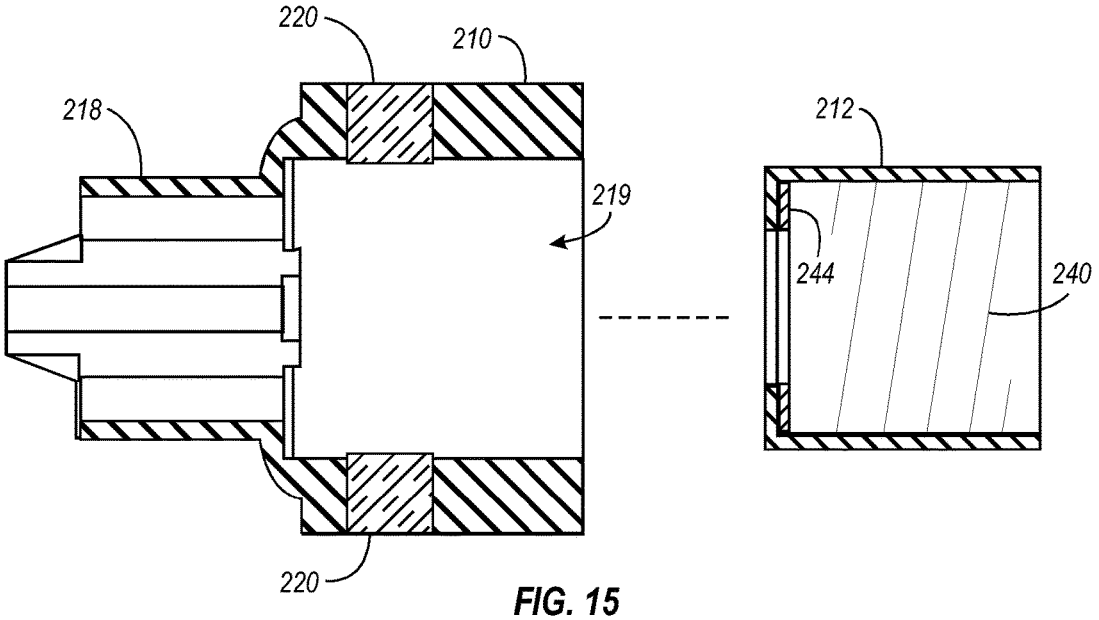
FIGS. 15-16 depict another embodiment of a coupling mechanism, shown being applied to light bulbs.
Figure 16:
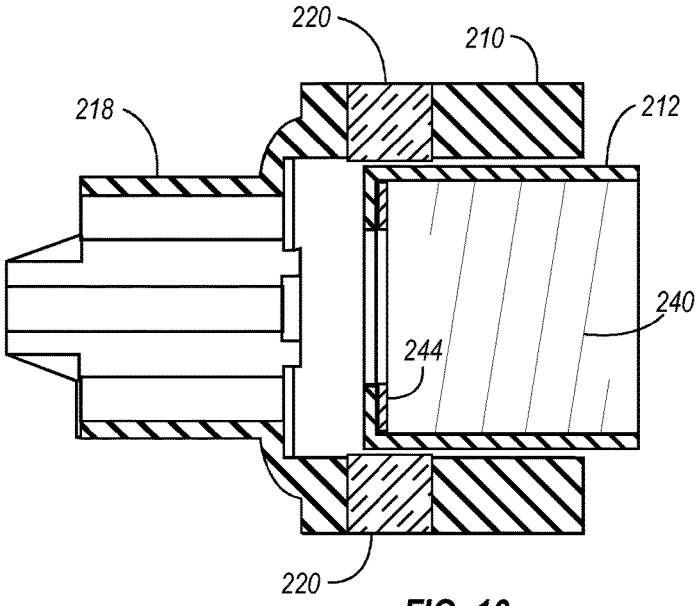

FIGS. 15-16 depict another embodiment of a coupling mechanism, shown being applied to light bulbs. FIG. 15 is an exploded sectional view depicting a base adapter 210 and a bulb adapter 212. FIG. 16 shows the base adapter 210 and bulb adapter 212 attached. For clarity, a light bulb and light socket are not shown. The bulb adapter 212 has female threads 240 configured to receive the threads of a light bulb. The base adapter 210 has male threads 218 configured to thread into a light socket. The bulb adapter 212 and base adapter 210 are configured to couple together in a manner that allows a user to quickly and easily install and remove a light bulb.

A cavity 219 is formed in the top end of the base adapter 210. The cavity 219 is configured to receive the bulb adapter 212. The electrical connections needed to power the light bulb are provided in the cavity 119, as shown, or in a manner similar to that illustrated in FIG. 14. To secure a light bulb and bulb adapter 212 within the cavity 219, a pair of magnets 220 is formed in the wall of base adapter 210. In the example shown, two magnets 220 are positioned on the opposite sides of the base adapter 210. In other examples, more or less magnets may be used. In this example, a magnetic ring 244 (or alternatively, a magnetic receptive ring) is disposed near the bottom of the bulb adapter 212. The magnetic ring 244 will hold the light bulb in place, due to magnetic attraction between the magnets 220 of the base adapter 210 and the magnetic ring 244. When the bulb adapter 212 is threaded onto a light bulb, the light bulb and adapter 212 can be inserted into the base adapter 210 without a user being required to rotate the light bulb. When the light bulb and adapter 212 are inserted far enough, the magnetic attraction between the magnets 220 and the magnetic ring 244 will hold the light bulb in place.

Figure 17:
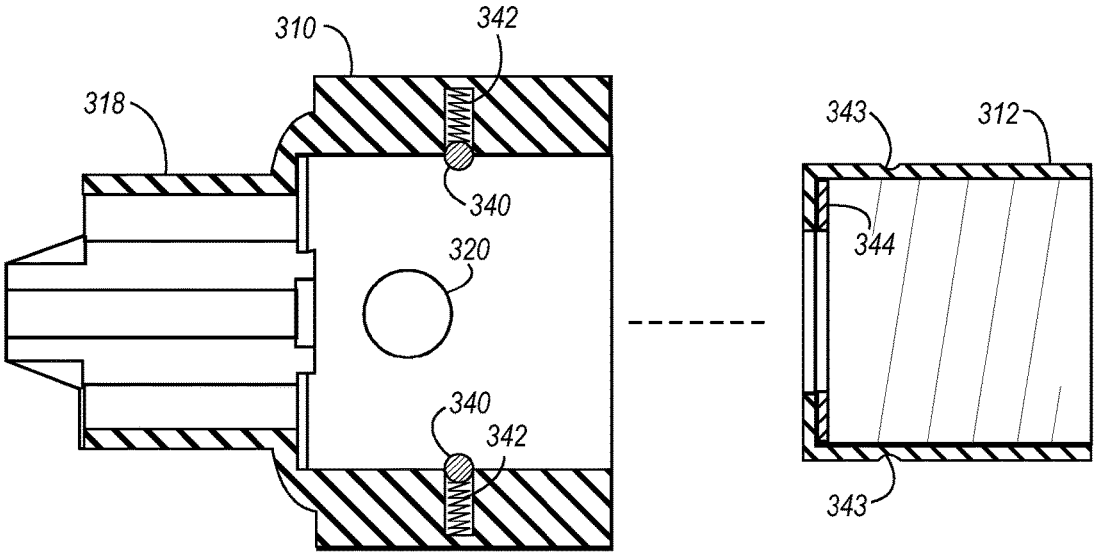
FIG. 17 is an exploded sectional view depicting another embodiment of a coupling mechanism.
Figure 18:
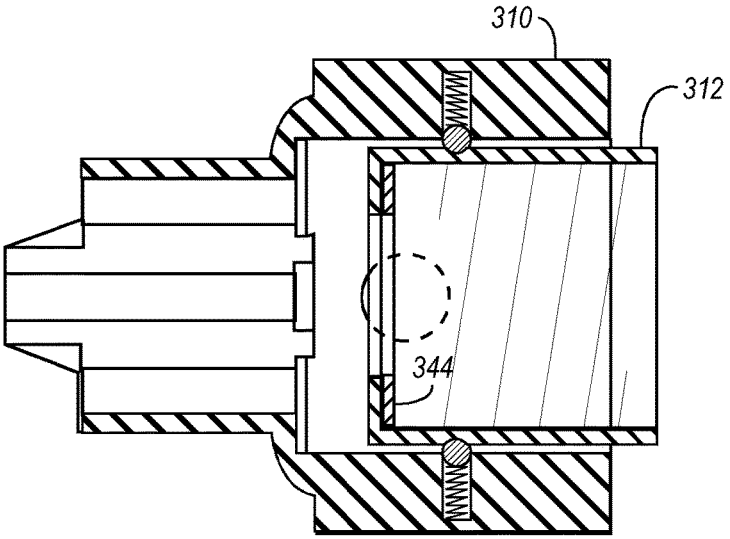
FIG. 18 is a sectional view depicting the coupling mechanism of FIG. 17 assembled.

FIGS. 17-18 depict another embodiment of a coupling mechanism having a secondary securing means, shown being applied to light bulbs. FIG. 17 is an exploded sectional view depicting a base adapter 310 and a bulb adapter 312. FIG. 18 shows the base adapter 310 and bulb adapter 312 attached. For clarity, a light bulb and light socket are not shown. Other than the secondary securing means (described below), the adapters 310 and 312 can be the same, or similar to the adapters 210 and 212 shown in FIGS. 15-16.

Referring to FIG. 17, the base adapter 310 includes threads 318, configured to thread into a light socket. Magnets 320 are formed in the wall of the adapter 310. In the example shown in FIGS. 17-18, a secondary securing means is provided by a pair of spring ball plungers and corresponding grooves. In other examples, more or less than two secondary securing means may be used. Each ball spring plunger includes a ball 340, which is biased toward the cavity of the adapter 310 by spring 342. A corresponding groove(s) 343 is formed the bulb adapter 312. When the bulb adapter 312 is inserted into the base adapter 310 (FIG. 18), the spring balls 340 will help hold the bulb adapter 312 in place by engaging the grooves 343. As shown in FIG. 18, in this position, the adapter 312 is secured in place by both the secondary securing means and the magnetic coupling.

To install a light bulb using either of the embodiments illustrated in FIGS. 15-18, a base adapter 210/310 is screwed into the socket of a light fixture. A bulb adapter 212/312 is screwed onto the bulb to be installed. With both adapters installed, a user has to merely insert the bulb (along with the bulb adapter 212/312) into the cavity of the base adapter 210/310 until the bulb adapter 212/312 magnets 220/320 engage the magnetic ring 244/344, which will hold the bulb in place. In the embodiment shown in FIGS. 17-18, the secondary securing means will also assist in holding the bulb in place. To remove the bulb, a user will pull on the bulb with sufficient force to overcome the magnetic force holding the bulb and socket together (and the force of the secondary securing means, if used).

FIG. 19 is an "unwrapped" view of the interior wall of the base adapter 110 shown in FIGS. 4-7, showing the channels 132 in more detail. As shown, four downward sloping channels 132 are formed, extending downward and terminating at termination points 136. Magnets 120 are disposed proximate the termination points 136. An upper surface of the each channel 132 is provided by retention surface 134. When the bulb adapter 112 is fully inserted in the base adapter 110 (with the protrusions 142 proximate the termination points 136, the magnets 120/144 will hold the adapters in position. The retention surface 134 will also prevent the bulb adapter 112 from pulling out, unless sufficient rotational force is applied to disengage the magnets 120/144.

FIG. 20 is an unwrapped view of the interior wall of another embodiment of a base adapter, with a secondary securing means. FIG. 20 is the same as FIG. 19, but includes a secondary securing means for applications where a more secure connection is desired. In this example, a perpendicular channel (or "serif") 154 is formed near the termination points 136. When the protrusions 142 of the bulb adapter 112 are disposed within the serifs 154, additional rotational resistance is provided, preventing the bulb from being rotated, without pushing in on the bulb, to move the protrusions 142 out of the serifs 154. To remove a bulb in this example, a user simply presses inwards slightly while turning the bulb counterclockwise.

Figure 21:
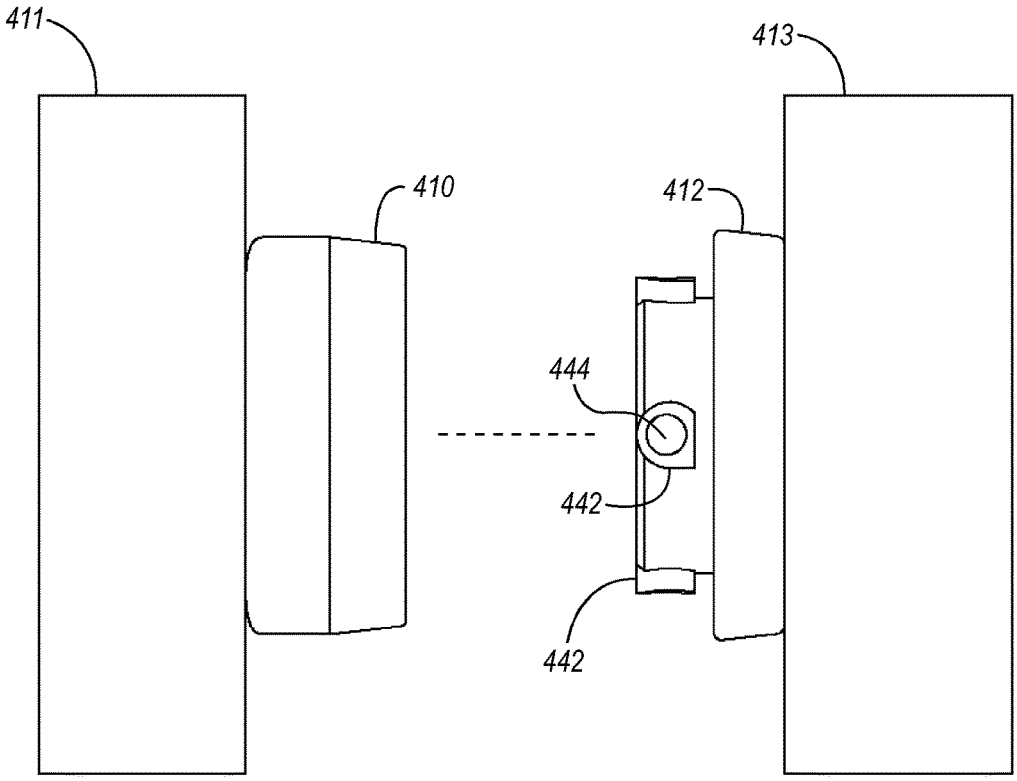
FIGS. 21-22 provide an example of a coupling mechanism used to secure two objects together.
Figure 22:
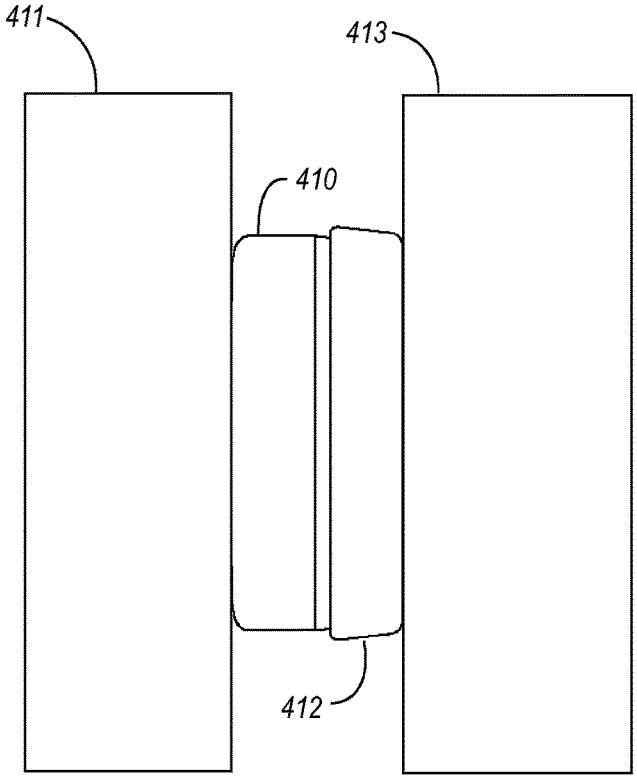

The coupling mechanisms described above were described in the context of light bulbs and light sockets, as examples only. The coupling mechanisms described can be applied to any other desired applications. FIGS. 21-22 provide an example of a coupling mechanism used to secure two objects together. In the examples shown, a coupling mechanism similar to that shown in FIGS. 1-14 is used.

FIG. 21 is an exploded side view of a first coupling member 410 coupled to a first object 411 and a second coupling member 412 coupled to a second object 413. FIG. 22 is a side view of the first object 411 coupled to the second object 413 via first and second coupling members 410 and 412. The first member 410 and second member 412 are similar to the base adapter 110 and bulb adapter 112 shown in FIGS. 1-14, but without the light bulb/socket threads, electrical contacts, etc. As before, the first member 410 includes channels, magnets, etc. (not shown) like those shown in FIGS. 4-7 and the second member 412 includes protrusions 442 and magnets 444 like those shown in FIGS. 8-11. The objects 411 and 413 can be any desired objects, walls, surfaces, tools, interchangeable accessories, doors/latches, etc., as desired. To secure the second object 413 to the first object 411, a user simply inserts and slightly rotates the second member 412 into the first member 410, in the same manner as described above with respect to the adapters shown in FIGS. 1-14.

In the preceding description, the disclosure is described with reference to specific exemplary embodiments thereof. Various modifications and changes may be made thereto without departing from the broader spirit and scope of the disclosure. The specification and drawings are, accordingly, to be regarded in an illustrative rather than a restrictive sense.

What is claimed is:

1. A light bulb coupling mechanism comprising:

a first adapter configured to attach to a light bulb socket, the first adapter having a cavity with a plurality of grooves formed in the cavity;

for each of the plurality of grooves, a first magnetic material coupled to the first adapter in the proximity of a respective groove;

a second adapter configured to attach to a light bulb, the second adapter having a plurality of protrusions extending from the second adapter; and for each of the plurality of grooves, a second magnetic material coupled to the second adapter in the proximity of a respective protrusion, wherein the first and second magnetic materials attract each other to bias the first and second adapters in a position where each of the plurality of protrusions are positioned in a respective groove proximate the respective first magnetic material.

2. The light bulb coupling mechanism of claim 1, wherein each groove slopes downward and terminates proximate the position of the respective first magnetic material.

3. The light bulb coupling mechanism of claim 2, further comprising, for each groove, a retaining surface disposed proximate the position of the respective first magnetic material and extending inward to retain a respective protrusion within the respective groove.

4. The light bulb coupling mechanism of claim 1, wherein the first and second magnetic materials are comprised of magnets.

5. The light bulb coupling mechanism of claim 1, wherein one of the first or second magnetic materials is comprised of a magnet and the other is comprised of a magnetic receptive material.

6. The light bulb coupling mechanism of claim 1, further comprising a contact assembly coupled to the first adapter for providing electrical contact between a light bulb and a socket.

7. The light bulb coupling mechanism of claim 6, further comprising a second contact assembly coupled to the first adapter for providing a second electrical contact between the light bulb and the socket.

8. The light bulb coupling mechanism of claim 1, wherein first adapter has four grooves and the second adapter has four protrusions.

9. A method of coupling light bulbs to light bulb sockets comprising:

providing a first adapter, the first adapter having a plurality of protrusions extending radially outward from the respective adapter, each of the plurality of protrusions including a first magnetic material;

providing a second adapter, the second adapter having a cavity with a plurality of grooves formed therein, each of the plurality of grooves having a termination point with a second magnetic material in the proximity of the respective termination point, wherein the first and second magnetic materials attract one another;

attaching one of the first or second adapters to a light bulb and attaching the other to a light bulb socket; and placing the first and second adapters together such that each protrusion is positioned proximate a termination point of a respective groove and each first magnetic material is positioned proximate a respective second magnetic material.

10. The method of claim 9, wherein each of the plurality of grooves slopes downward toward the respective termination point.

11. The method of claim 10, further comprising providing, for each of the plurality of grooves, a retaining surface disposed proximate the termination point and extending inward to retain a respective protrusion within the respective groove.

12. The method of claim 9, wherein the first and second magnetic materials are comprised of magnets.

13. The method of claim 9, wherein one of the first or second magnetic materials is comprised of a magnet and the other is comprised of a magnetic receptive material.

14. The method of claim 9, further comprising providing a contact assembly coupled to at least one of the first or second adapters for providing electrical contact between the light bulb and the socket.

15. The method of claim 14, further comprising providing a second contact assembly coupled to at least one of the first or second adapters for providing a second electrical contact between the light bulb and the socket.

16. The method of claim 9, wherein first adapter has four protrusions and the second adapter has four grooves.

* * * * *